US011103424B1

(12) United States Patent
Hornthal et al.

(10) Patent No.: US 11,103,424 B1
(45) Date of Patent: Aug. 31, 2021

(54) PACIFIER DEVICES

(71) Applicants: David Adam Hornthal, Deerfield, IL (US); Erica Joy Hornthal, Deerfield, IL (US)

(72) Inventors: David Adam Hornthal, Deerfield, IL (US); Erica Joy Hornthal, Deerfield, IL (US)

( * ) Notice: Subject to any disclaimer, the term of this patent is extended or adjusted under 35 U.S.C. 154(b) by 0 days.

(21) Appl. No.: 17/028,677

(22) Filed: Sep. 22, 2020

(51) Int. Cl.
*A61J 17/00* (2006.01)

(52) U.S. Cl.
CPC ..... *A61J 17/001* (2015.05); *A61J 17/111* (2020.05)

(58) Field of Classification Search
CPC ..... A61J 17/001; A61J 17/111; A61J 17/1115; A61J 17/1111; A61J 17/10; A63H 3/003
See application file for complete search history.

(56) References Cited

U.S. PATENT DOCUMENTS 4,697,589 A * 10/1987 King ..... A61J 17/1111 606/234
2010/0155440 A1* 6/2010 Hoyt ..... A61J 9/06 224/250
2010/0234887 A1* 9/2010 Smith ..... A61J 17/1111 606/236
2016/0199264 A1* 7/2016 McClintock ..... A61J 17/1111 446/73
2016/0236103 A1* 8/2016 Pettrey, III ..... A63H 3/005
2016/0325193 A1* 11/2016 Stewart ..... A63H 3/04
2019/0175454 A1* 6/2019 Pierce ..... A63H 3/02

* cited by examiner

*Primary Examiner* — Diane D Yabut
*Assistant Examiner* — Christina C Lauer
(74) *Attorney, Agent, or Firm* — Nixon Peabody LLP

(57) ABSTRACT

A pacifier device includes a body. A first arm extends from the body. A first sucker is coupled to a distal end portion of the first arm. A second arm extends from the body. A second sucker is coupled to a distal end portion of the second arm.

27 Claims, 6 Drawing Sheets

PACIFIER DEVICES

TECHNICAL FIELD

This disclosure relates to pacifier devices and more specifically to pacifier devices with multiple suckers.

BACKGROUND

Parents and care givers use pacifiers to help soothe babies for many reasons. Often, babies spit out the pacifier and/or lose the pacifier unintentionally, which can cause the baby to become upset. In some instances, babies hold a portion of the pacifier, but cannot readily locate the sucker portion that they want to suck or chew.

Pacifiers have been coupled to plush toys which can stimulate and engage infants. However, the attached toy can be distracting and even frustrating to the child, parent or guardian. Where the device, such as a plush toy with one sucker, can be placed on an infant, the placement of the toy can determine if the sucker is well positioned to be accepted by the infant's mouth. Attachment of the sucker to the plush toy is also typically by a single tab, where if the toy falls on the wrong side, the sucker can end up face down. Therefore, the sucker can end up poorly oriented with respect to the infant, or far from the infant, who may try to suck or chew on whatever portion of the plush animal or sucker is closest to their mouth. Conventional suckers are also not symmetric from top to bottom and, when in use, ventilation holes, that are located in a top portion, are close to the infant's nose to facilitate breathing. If the plush animal is upside down, the ventilation holes are not properly disposed and can cause discomfort leading to the child spitting out the pacifier and or crying. The plush toy in general is also easy to tip over, or has low symmetry, and this can exacerbate the frustrations already noted. These issues may require the parent or guardian to repeatedly intervene and re-orient the plush animal so the pacifier is directed into the infant's mouth.

There is therefore a need for pacifier and pacifier devices that are easy for a child to locate and use. The present disclosure is directed to this need and addressing other problems.

SUMMARY

According to some implementations of the present disclosure, a pacifier device includes a body. A first arm and a second arm extend from the body. A first sucker is coupled to a distal end portion of the first arm, and a second sucker is coupled to a distal end portion of the second arm. Optionally, the pacifier device further includes a third arm extending from the body, and a third sucker coupled to a distal end portion of the third arm.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1:
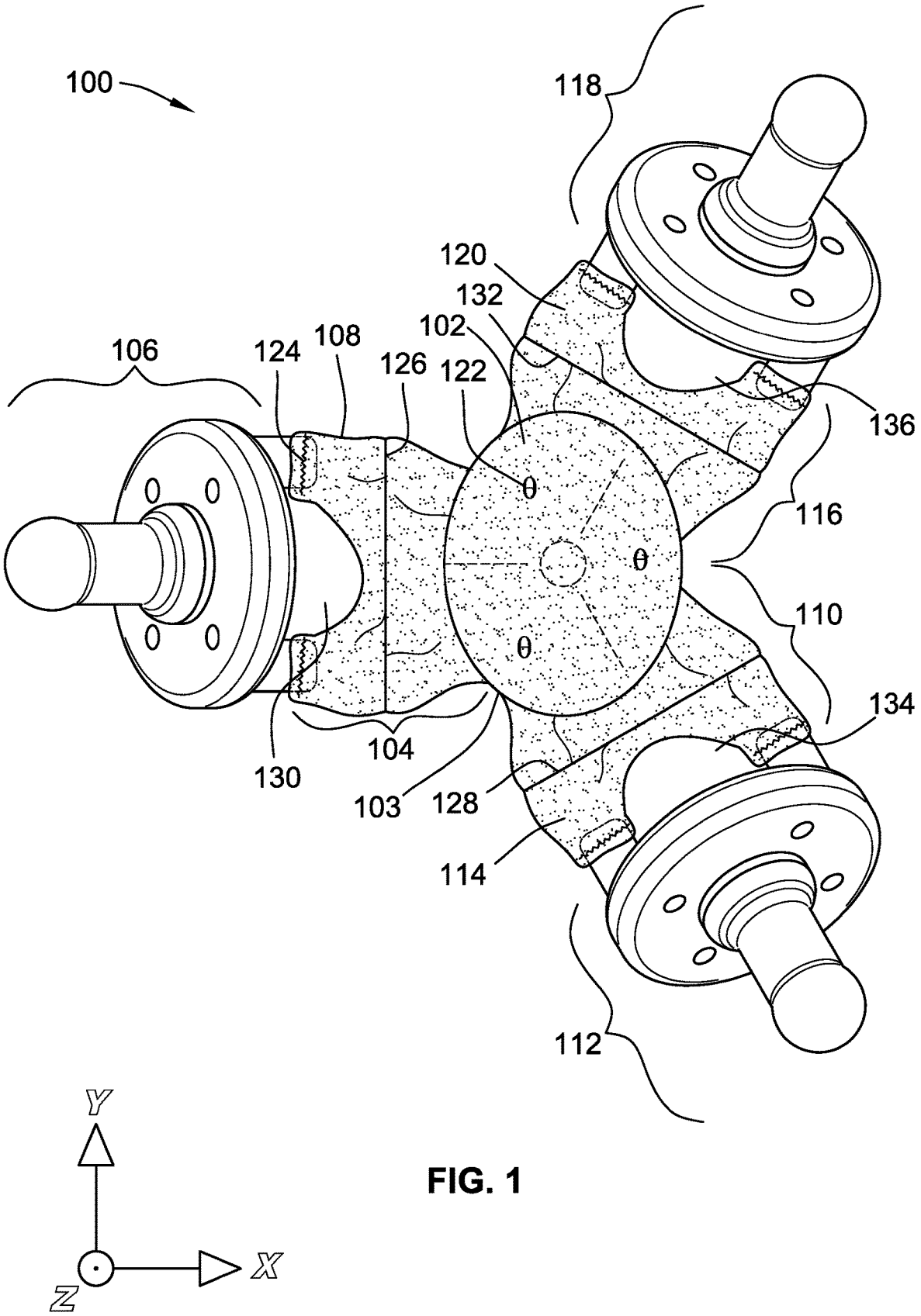
FIG. 1 shows a perspective view of a pacifier device 100 according to some implementations of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

The present disclosure is directed to a pacifier device that has multiple (e.g., two, three, four, etc.) suckers attached to a plush body. The pacifier device has multiple legs/arms and/or attachment points that are spaced from one another to space the suckers about the pacifier device.

Referring generally to FIG. 1 a pacifier device 100 is shown. A first arm 104, and a second arm 110 extend from a body 102. A first sucker 106 is coupled to a distal portion of the first arm 108, and a second sucker 112 is coupled to a distal portion of the second arm 114.

According to some implementations, the pacifier devices can include two, three, four or more arms with suckers attached thereto. For example, a third arm 116 is shown extending from the body 102 of pacifier device 100. A third sucker 118 is couple to a distal end portion of the third arm 120. Other implementations can include a fourth arm extending from the body 102, and a fourth sucker coupled to a distal end portion of the fourth arm.

The body 102 can be any shape. In some other implementations, the central body is a geometric shape, for example circular (as shown), square, doughnut, rectangular, star shaped, triangular shape etc. In some implementations, the central body is in the shape of a mythical or real animal, such as such as a unicorn or an octopus. In some in some implementations, the central body is in the shape of a plant, such as a flower. In some implementations, the central body is an irregular shape.

In some implementations, the body 102 is generally flat, wherein the average dimensions of width/height or circumference (XY directions shown in FIG. 1) is greater than the average depth (Z direction, up and out of the page). In part due to the generally flat configuration of the body 102, the body 102 tends to lie flat on a general level surface, and can be flipped over to also lie flatly on an opposite side.

Accordingly, the body 102 can lie on a child's body on either of the flat sides of the body 102, with two or more suckers 106, 112 generally pointing upwards.

The arms can be bi-furcated, such as in the distal portion of the first arm 108. The bi-furcation defines a notch 130 in first arm 104. Similar bifurcation defines a notch 134 in second arm 110 and a notch 136 in third arm 116.

The arms 104, 110 and 116 can be any useful length but are generally proportioned to not extend beyond a child's belly when the pacifier device 100 is placed on the child. In some implementation the arms extend from the center of the body 102 between about 1.5" and 6". In some implementations, each of the first arm 104, the second arm 110 and the third arm 116 are of about equal length.

The arms can be attached at any position around the body 102, such as at any radial position along a periphery 103 of the central body. In some implementations, the arms are regularly spaced around the body. For example, arms 104, 110, 116 project radially from the body 102 and are space at regular angles 122 of θ=120 degrees. In implementations having two arms, the arms can be about 180 degrees, or opposite to each other. In implementations having four arms, the arms can be about 90 degrees.

In some implementations, the suckers are fixed to the distal ends of the arm to which they are coupled. As used herein "fixed" refers to a permanent coupling. The suckers can be fixed to their corresponding arm by any method. For example, the suckers can be fixed to the corresponding arm using one or more of an adhesive, a tread, a rivet, a melt weld etc. In some implementations, the first sucker 106 is fixed to the distal end portion of the first arm 108 using one or more stitches 124. In some implementations, the stitches are hidden inside an arm, such as the distal end portion of the first arm 108.

According to some other implementations, the suckers are removably coupled to the distal ends of the arm to which they are coupled. For example, the coupling can be provided by hook and loop fasteners, snaps, clips, toggles, zippers, or any combinations thereof. In some implementations, the first sucker 106 is removably coupled to the distal end portion of the first arm 108 via a first fastener, the second sucker 112 is removably coupled to the distal end portion of the second arm 114 via a second fastener, and the third sucker 118 is removably coupled to the distal end portion of the third arm 120 via a third fastener. This removable coupling feature allows the suckers, such as suckers 106, 112, and 118, to be removed from the rest of the body of the pacifier device 100 and for cleaning or replacement. For example, where the sucker can be clean and sterilized such as by immersion in boiling water.

Figure 2A:
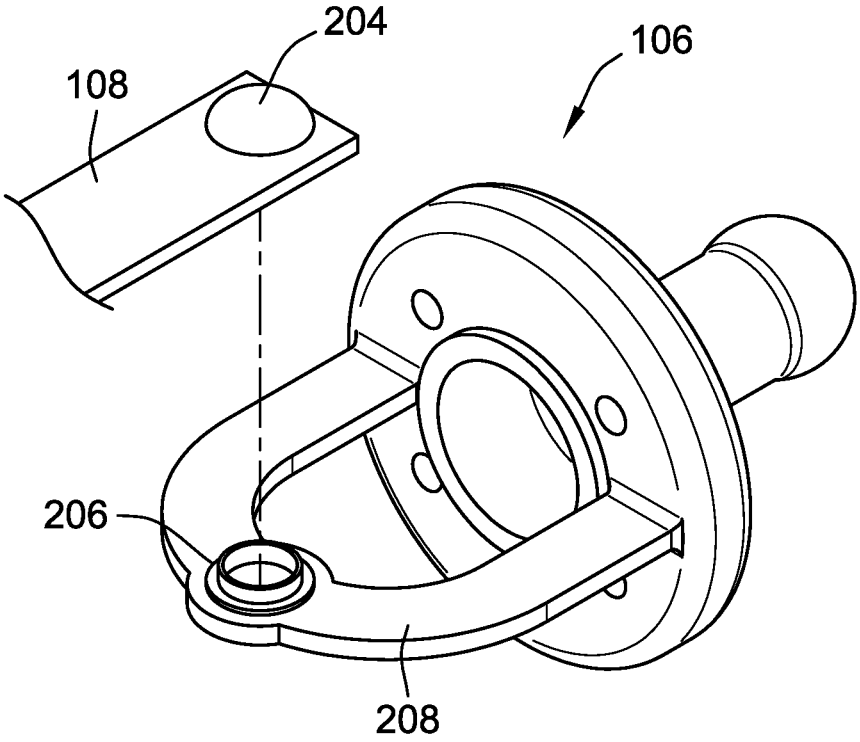
FIG. 2A shows a perspective view of a sucker and a first optional removable coupling feature according to some implementations of the present disclosure.

FIG. 2A shows a perspective view of an embodiment of a snap for a pacifier device such as device 100. The first snap portion 204 is located on the distal end of an arm, such as first arm 108. The second snap portion 206 is located on an attachment portion 208 of a sucker, such as the first sucker 106. The first snap portion 204 couples to the second snap portion 206, thereby removably coupling the sucker 106 to the first arm 104. In some implementations, more than one snaps are used.

Figure 2B:
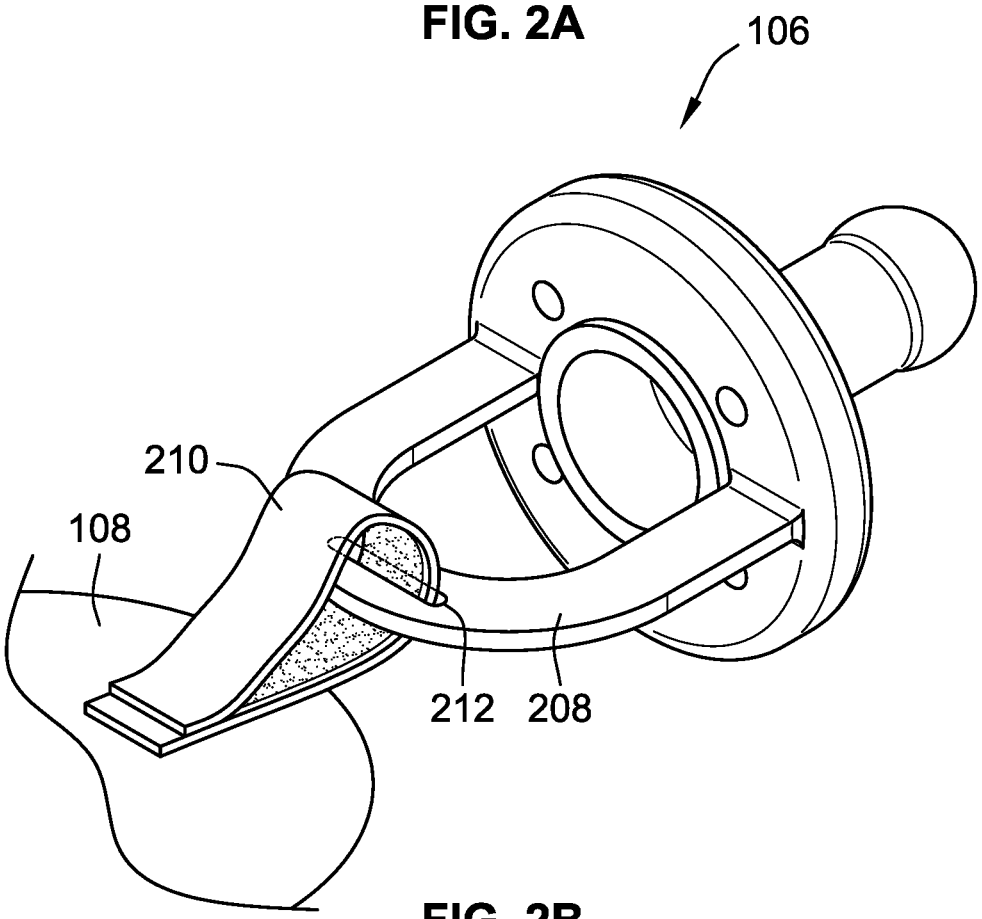
FIG. 2B shows a perspective view of a sucker and a second optional removable coupling feature according to some implementations of the present disclosure.

FIG. 2B shows a perspective view of the first sucker 106 including a hook and loop fastener 210. A hook and loop containing strip 210 is located on the distal end of first arm 108. The hook and loop fastener 210 is inserted into a mating slot 212 positioned in the attachment portion 208 of the first sucker 106. Bending the hook and loop fastener 210 on itself removably couples the first sucker 106 to the distal end of first arm 108. Other implementations are possible include using two or more hook and loop fasteners. Another possible implantation includes a hook or loop portion located on the distal end of first arm 108, and the other of the hook or loop portion located on the attachment portion 208 of the first sucker 106.

Another feature according to some implementations includes a hinge, such as a first hinge portion 126 that is shown in FIG. 1. The first hinge portion 126 is formed in the first arm 104 adjacent to the first sucker 106 to aid the first sucker 106 in moving relative to the body 102. A second hinge portion 128 is formed in the second arm 110 adjacent to the second sucker 112 to aid the second sucker 112 in moving relative to the body 102. Similarly, in options where a third sucker is used, a third hinge portion 132 is formed in the third arm 116 to aid the third sucker 118 in moving relative to body 102.

The hinge 126 can be formed by any method. For example, by heat sealing, application of an adhesive, ultrasonic welding, or stitching. In some implementations the first hinge portion 126 includes a first stitched line formed across a width of the first arm 104 and the second hinge portion 128 includes a second stitched line formed across a width of the second arm 110. In options where a third sucker is used, a third hinge portion 132 includes a third stitch line formed across a width of the third arm 116. In some implementations, the distal portion of the first arm 108 and the rest of the first arm 104 form two distinct elements that are connected by a hinge. For example, the hinge can be formed by loops of soft plastic or thread, or a flexible material such as a cloth or plastic.

As noted, the hinge 126 aids in allowing movement of the sucker relative to the body 102. Where the body 102 is flat and the entire pacifier device 100 can be flipped over to lie on either flat side, the suckers 106, 112, 118 can adjust to point upward in part facilitated by the respective hinges 126, 128 and 132. Where the device 100 is placed on a baby, this feature provides easy access to one of the two or more suckers. In addition, if the device 100 falls a floor or ground, the suckers are less likely to directly contact the floor or ground and thereby remain clean.

In some implementations, the body 102, and the arms, such as the first arm 104, the second arm 110, and the third arm 116 are formed by one or more sheets of material sewn together and stuffed with a plush material.

The sheets of material can be made of any material, such as hypoallergenic and flame resistant materials. For example, sheets of material can be made of any synthetic or natural materials including wool, cotton, nylon, spandex, polyester, leather, plastic, rubber, mixed compositions of these materials, and combinations of these. For example, fleeces made with one or more of these materials can be used to provide a plush exterior feel. The sheet materials can include a faux fur exterior, or can be more generally smooth. In some implementations, the sheet materials can include portions, patterns or sections having higher friction such as a soft plastic or silicon rubber features (e.g., disks, strips). These can aid in keeping the pacifier device 100 on a baby's stomach rather than slipping off. These can also provide a tactile stimulus and grip for the baby, for example when these higher friction features are included on the arms 104, 110 and 116.

The plush materials for stuffing can be any soft material such as soft hypoallergenic and flame resistant materials. Some examples include synthetic or natural materials including felt, wool, cotton, nylon, polyester, fleece, plastic, rubber, down and feathers, cellulosic materials (e.g., straw, wood wool, kapok), mixed blends of these materials, and combinations of these. For example, cotton, polyester foams and memory foams can be used.

In some implementations, the pacifier device 100, as well as serving to sooth an infant by way of the first sucker 106, also can be colorful, have features to make noise, or have appendages to provide visual, audible and/or tactile to the infant. For example, the arms, such as first arm 104 can be dimensioned to be easy to grip by an infant. As well as providing tactile stimulation, this feature can help the child build hand strength/coordination and aids in helping the child orient a sucker to their mouth. Accordingly, the materials making the first arm 104, the sheets and stuffing, are chosen and designed to compress to accommodate the size of an infant's grip. For example, the compressed diameter of the first arm 104, or a portion of the first arm 104, should be between about 0.1 and about 2". In addition, appendages, such as grips and nubs, can be added to the arms for easy gripping.

In some implementations materials or elements are included in the pacifier device 100 to make noises. For example, in some implementations a crinkle material is included in the sheets or stuffing used to make the arms or body of the pacifier device 100. Without limitation, the crinkly material can be selected from synthetic materials such as rayon and polyamide. As another example, a rattle or other noise making device can be added to the pacifier device, such as being sewn into the interior of the body 102 or an arm, such as first arm 104.

The pacifier device 100 can also include one or more weights, for example positioned within the body 102, the first arm 104, the second arm 110, the third arm 116, or any combination thereof. For example, the weights can include beads or beans made of plastic, rubber, metal, silicone, relatively dense plush material, or any combination thereof. The weights, such as bead, can be localized in pouches and optionally sewn into the sheets or material of the pacifier device 100. In some implementations, the one or more weights are only positioned within the body 102 and not in the first arm 104, the second arm 110, or the third arm 116. The one or more weights aid in maintaining a position of the pacifier device when in use on a chest of a baby.

In some implementations, the pacifier device includes a wire frame positioned at least partially within the body 102, the first arm 104, the second arm 110, and the third arm 116. The wire frame includes a metal wire coated with a second material. The second material including plastic, silicone, fabric, or any combination thereof. The wire frame aids in adjusting relative positions of the first arm, the second arm, and the third arm. In some implementations, the frame is excluded from the distal portions of the arms, such as the distal portion of the first arm 108 so that the hinge 126 is free to operate, allowing the first sucker 106 to freely swivel up and down.

Figure 3A:
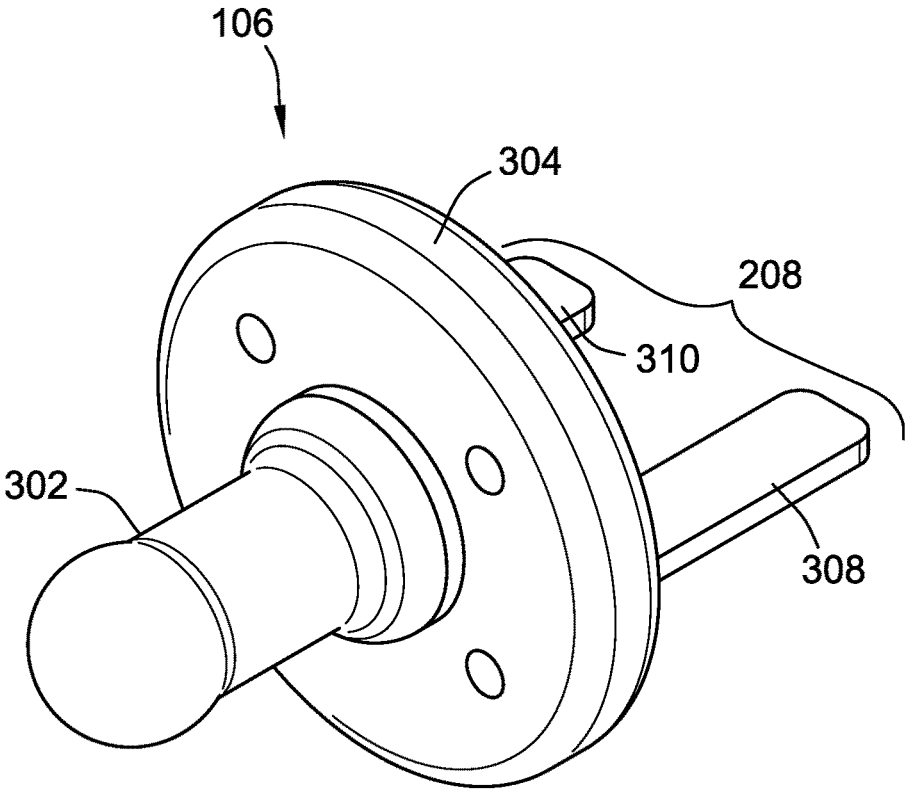
FIG. 3A shows a front perspective view of a sucker according to some implementations of the present disclosure.
Figure 3B:
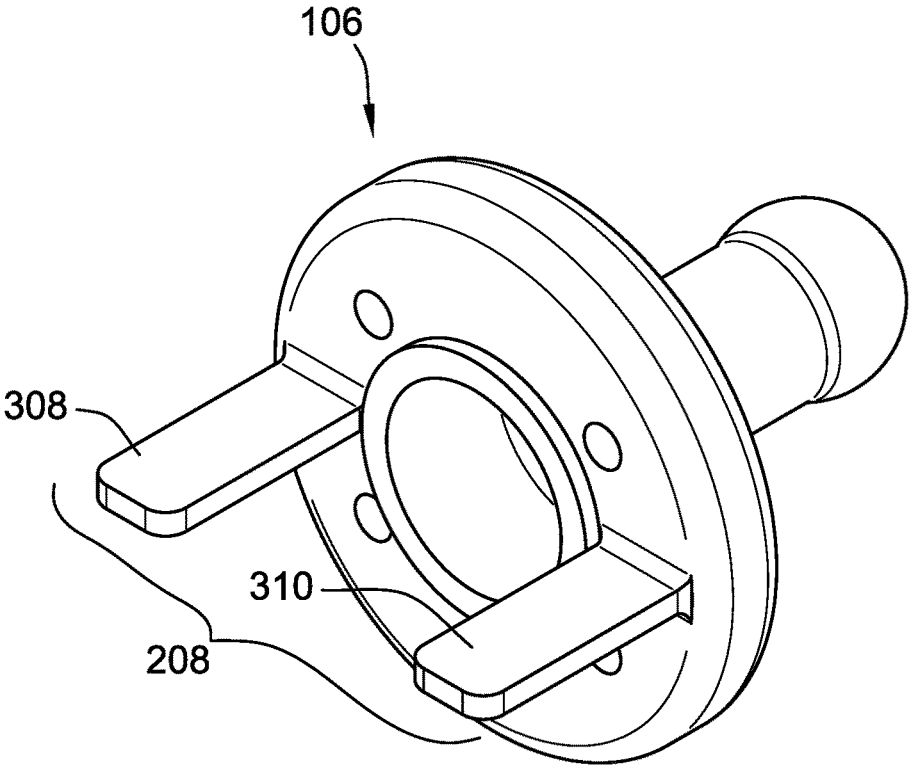
FIG. 3B shows a back perspective view of the sucker of FIG. 3A.

Turning now to FIGS. 3A and 3B, some details of an implementation of the first sucker 106 is shown. FIG. 3A is a front perspective view and FIG. 3B is a back perspective view. Both figures show the first sucker 106 including a nipple portion 302, a base portion 304, and the attachment portion 208. The base portion 304, at least in part, serves the purpose of a guard to prevent the first sucker 106 being swallowed. The nipple portion 302 is coupled to the base portion 304 and extends in a first direction therefrom. The attachment portion 208 is coupled to the base portion 304 and extends in a second opposing direction therefrom. In some implementations two or more of the nipple portion 302, the base portion 304 and the attachment portion 208 are a single unit, such as a molded unit. In some implementations, the nipple portion 302, and optionally the base portion 304 and attachment portion 208, are made of silicone, rubber, natural rubber or latex.

The attachment portion 208 can include two tab 308, 310. In some implementations, the two tabs 308 and 310 are connected. For example, the two tabs 308 and 310 may form a single attachment portion 208 as shown by the u shaped attachment portion 208 in FIGS. 2A and 2B.

Figure 4A:
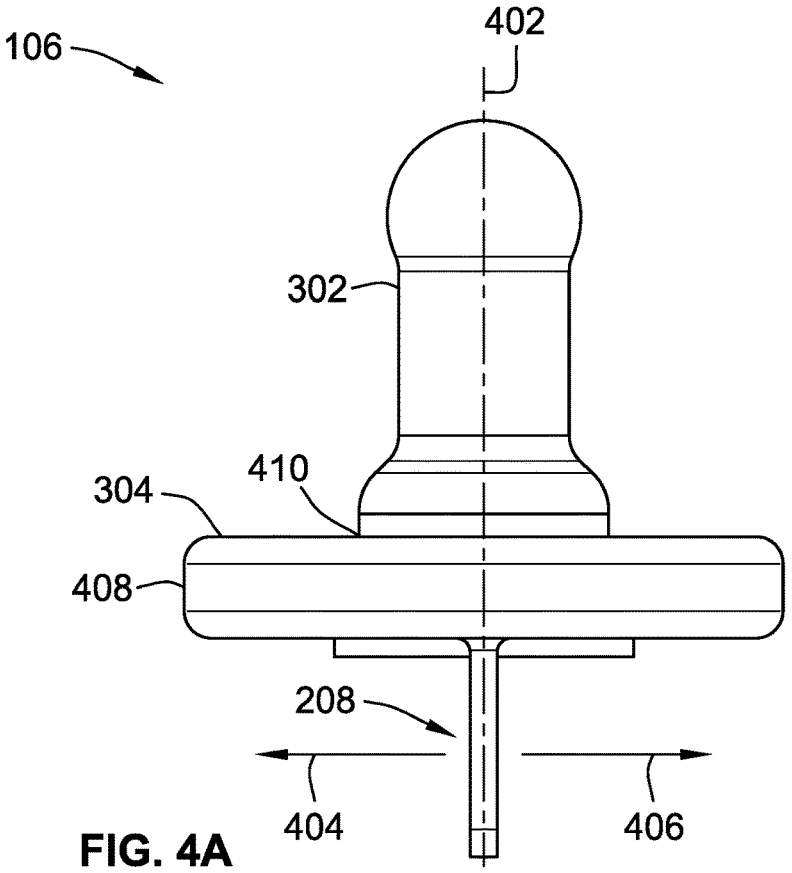
FIG. 4A shows a side view of the sucker of FIG. 3A.
Figure 4B:
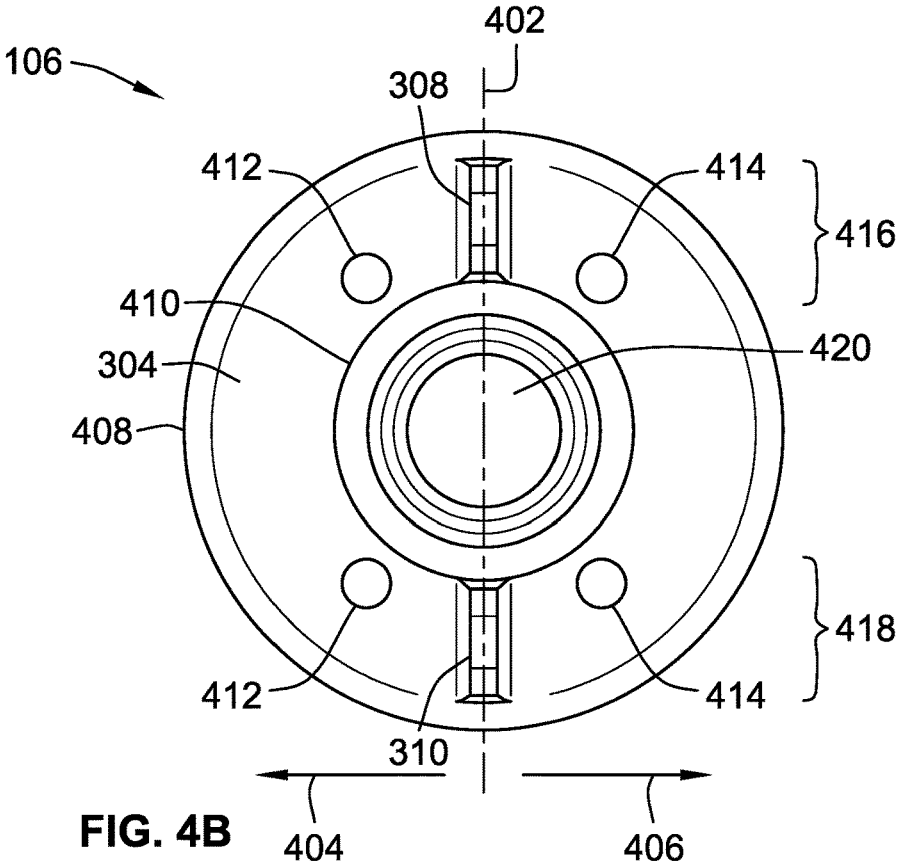
FIG. 4B shows a back view of the sucker of FIG. 3A.

FIGS. 4A and 4B show some other views of the first sucker 106 illustrated in FIGS. 3A and 3B. FIG. 4A is a side view of the first sucker 106, and FIG. 4B is a back view of the first sucker 106. These views also show the nipple portion 302, the base portion 304, and the attachment portion 208 or the tabs 308 and 310 of the attachment portion 208.

As shown by FIGS. 4A and 4B, the attachment portion 208 is coupled to the base portion 304 along a mirror plane 402 of the first sucker 106. The first sucker includes a first half, indicated by arrow 404, on a first side of the mirror plane, and a second half, indicated by arrow 406, on a second side of the mirror plane. The base portion 304 has an outer perimeter 408, and inner perimeter 410. In some implementations, the outer perimeter 408 and the inner perimeter 410 are independently generally circular in shape. Other shapes are contemplated for either of outer perimeter 408 or inner perimeter 410. For example, the shape can be more elliptical in shape or even rectangular, such as rectangular with rounded edges. In some implementations the shape includes flattened portions or facets.

The base portion 304 defines a first pair of breathing apertures 412 therein and a second pair of breathing apertures 414 therein. The first pair of breathing apertures 412 are located in the first half 404 of the sucker between the outer perimeter 408 and inner perimeter 410. The second pair of breathing apertures 414 are located in the second half 406 of the sucker between the outer perimeter 408 and inner perimeter 410. The breathing apertures 412 and 414 provide ventilation while the sucker is being used by a baby.

As previously described, the attachment portion 208 can include a first tab 308 and a second tab 310. The first tab 308 of the attachment portion 208 is located adjacent to a first side portion 416 of the base portion 304 that is between the inner and outer perimeters 408, 410. The second tab 310 of the attachment portion 208 is located adjacent to an opposing second side portion 418 of the base portion 304 that is between inner and outer perimeters 408, 410.

Figure 5:
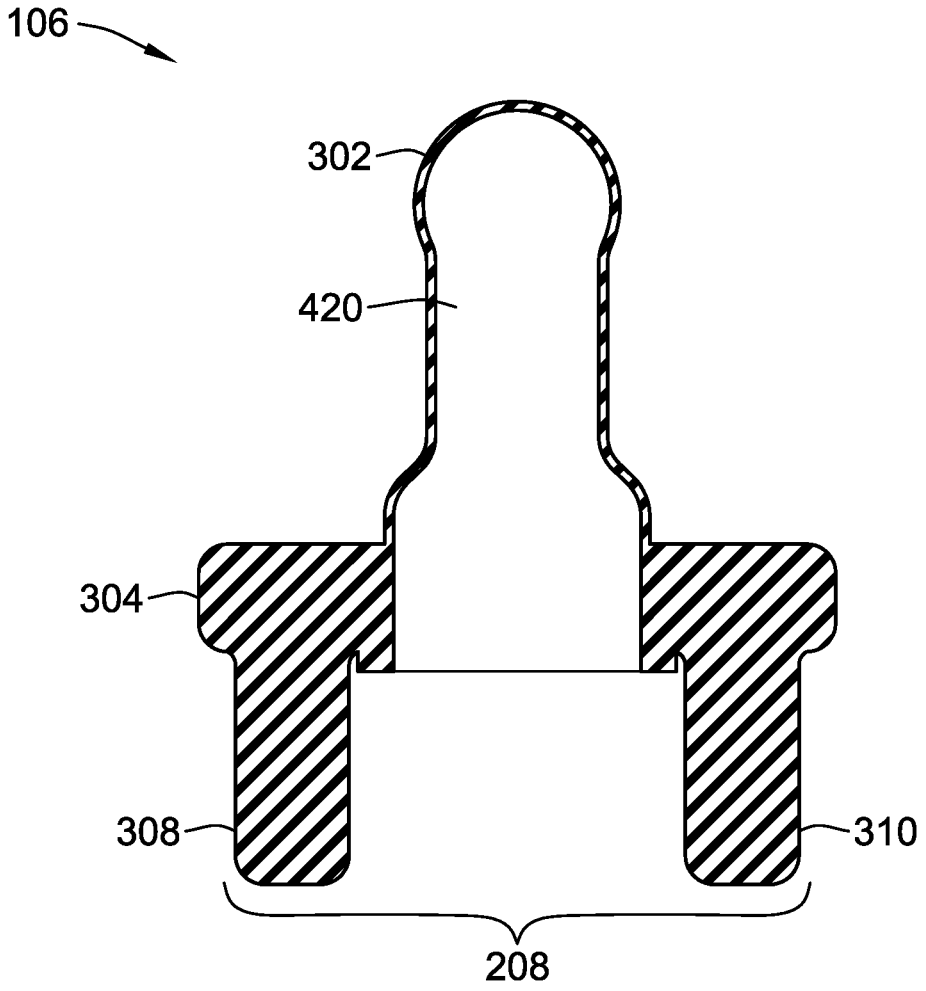
FIG. 5 shows a side cross-sectional view of the sucker of FIG. 3A.

FIG. 5 shows a cross cut side view of the first sucker 106. The cross cut view is along the mirror plane 402 defined previously (FIG. 4A, 4B). The nipple portion 302 and the base portion 304 of the first sucker 106 define a finger cavity 420. The figure cavity is configured to receive at least a portion of a finger therein. Access to the finger cavity 420 is generally defined as being between the first tab 308 and second tab 310 of the attachment portion. Access to the figure cavity 420 is further defined as being generally defined between the first pair of breathing apertures 412 and second pairs of breathing apertures 414 (FIG. 4A, 4B). Notches, such as notch 130, (FIG. 1) at the distal end portion of the first arm 104 also aid in providing access to the finger cavity. The finger cavity aids in allowing a parent or guardian to direct a pacifier, such as a first sucker 106, into an infant's mouth.

Figure 6:
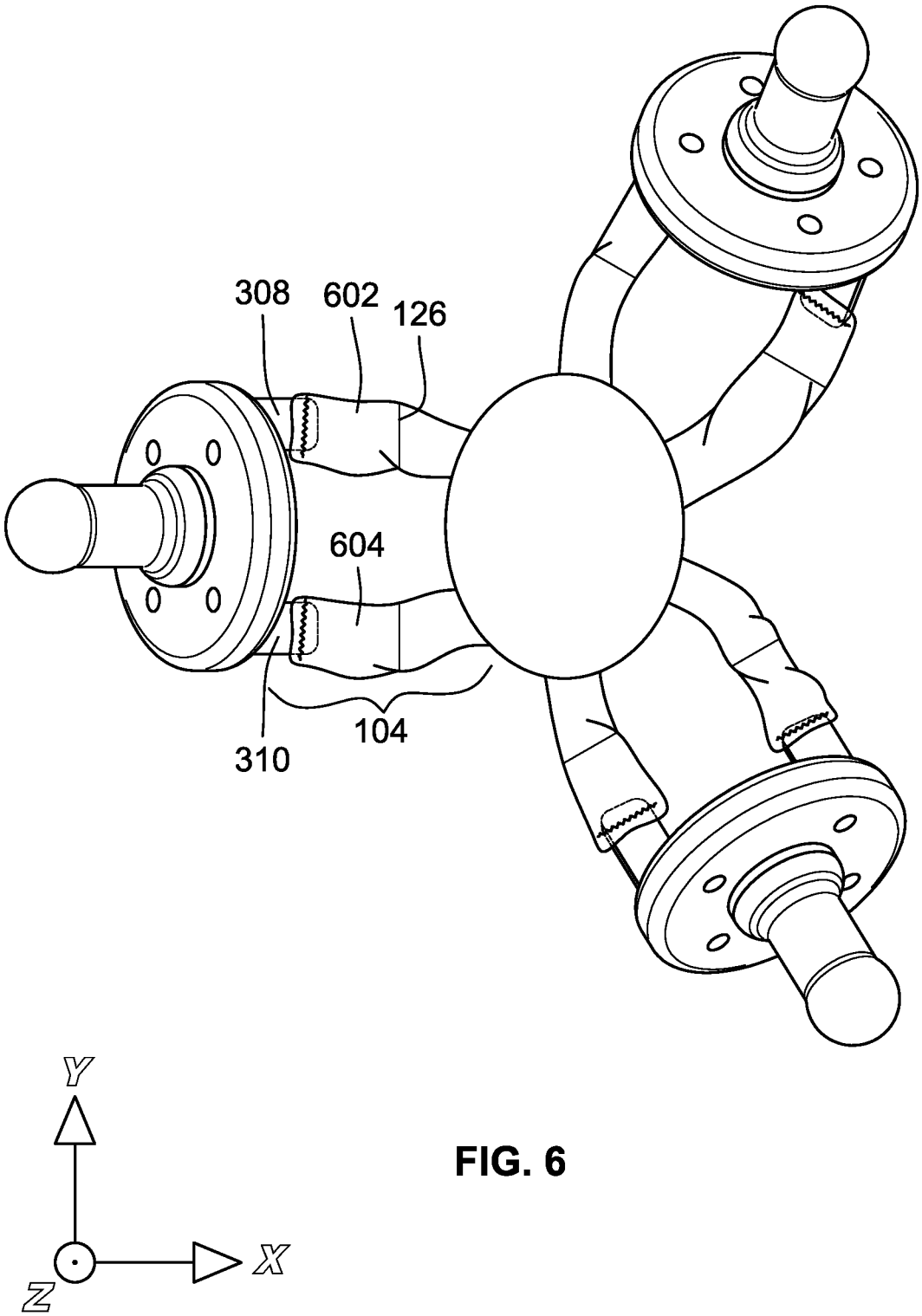
FIG. 6 shows a perspective view of a pacifier device 600 according to some implementations of the present disclosure.

FIG. 6 shows an alternative pacifier device 600 according to some implementations. Pacifier device 600 is similar to pacifier device 100 but include an extreme bi-furcation of the arms attached to the body 102. Each of the arms connecting the body 102 to one of the pacifiers, such as first arm 104, includes a first branch 602 and a second branch 604. The first branch 602 is connected to the first tab 308, and the second branch 604 is connected to the second tab 310. Other features are appropriately modified. For example, the hinge 126, is included on both the first branch 602 and the second branch 604.

While the present disclosure has been described with reference to one or more particular embodiments and implementations, those skilled in the art will recognize that many changes may be made thereto without departing from the spirit and scope of the present disclosure. Each of these embodiments and implementations and obvious variations thereof is contemplated as falling within the spirit and scope of the present disclosure, which is set forth in the claims that follow.

What is claimed is:

1. A pacifier device comprising:

a body having a first side and a second side opposing the first side, the first side and the second side being configured to lie uniformly against a surface of a user;

a first arm extending from the body, the first arm having bifurcated open branches that form a first notch at a distal end portion thereof;

a first sucker coupled to the distal end portion of the first arm, the first sucker including:

a base portion;

a nipple portion, coupled to the base portion and extending in a first direction therefrom, the nipple portion and the base portion of the first sucker defining a finger cavity configured to receive at least a portion of a finger therein; and an attachment portion coupled to the base portion and extending in a second opposing direction therefrom, the attachment portion including a first tab located adjacent to a first side portion of the base portion and a second tab located adjacent to an opposing second side portion of the base portion, a first of the bifurcated open branches of the first arm being coupled to the first tab and a second of the bifurcated open branches of the first arm being coupled to the second tab such that the first notch aids in providing access to the finger cavity of the first sucker; and a second arm extending from the body, the second arm having bifurcated open branches that form a second notch at a distal end portion thereof; and a second sucker coupled to the distal end portion of the second arm.

2. The pacifier device of claim 1, further comprising:

a third arm extending from the body; and a third sucker coupled to a distal end portion of the third arm.

3. The pacifier device of claim 2, wherein the first, second, and third arms extend from the body such that the first, second, and third arms are generally about 120 degrees apart.

4. The pacifier device of claim 2, wherein each of the first, second, and third arms is between about 1.5 inches and about 6 inches in length.

5. The pacifier device of claim 2, further comprising:

a fourth arm extending from the body; and a fourth sucker coupled to a distal end portion of the fourth arm.

6. The pacifier device of claim 5, wherein the first, second, third, and fourth arms extend from the body such that the first, second, third, and fourth arms are generally about 90 degrees apart.

7. The pacifier device of claim 2, wherein the first sucker is fixed to the distal end portion of the first arm using one or more stitches, the second sucker is fixed to the distal end portion of the second arm using one or more stitches, and the third sucker is fixed to the distal end portion of the third arm using one or more stitches.

8. The pacifier device of claim 2, wherein the first sucker is removably coupled to the distal end portion of the first arm via a first fastener, the second sucker is removably coupled to the distal end portion of the second arm via a second fastener, and the third sucker is removably coupled to the distal end portion of the third arm via a third fastener.

9. The pacifier device of claim 8, wherein the first fastener, the second fastener, and the third fastener include hook and loop fasteners, snaps, clips, toggles, zipper or any combination thereof.

10. The pacifier device of claim 2, wherein the body, the first arm, the second arm, and the third arm are formed by one or more sheets of material sewn together and stuffed with a plush material.

11. The pacifier device of claim 10, further comprising one or more weights positioned within the body, the first arm, the second arm, the third arm, or any combination thereof, the one or more weights aiding in maintaining a position of the pacifier device when in use on a chest of a baby.

12. The pacifier device of claim 11, wherein the one or more weights are only positioned within the body and not in the first arm, the second arm, or the third arm.

13. The pacifier device of claim 11, wherein the one or more weights include beads or beans made of plastic, rubber, metal, silicone, relatively dense plush material, or any combination thereof.

14. The pacifier device of claim 10, further comprising a wire frame positioned at least partially within the body, the first arm, the second arm, and the third arm, to aid in adjusting relative positions of the first arm, the second arm, and the third arm.

15. The pacifier device of claim 14, wherein the wire frame includes a metal wire coated with a second material, the second material including plastic, silicone, fabric, or any combination thereof.

16. The pacifier device of claim 1, further comprising a first hinge portion formed in the first arm between the body and the first sucker to aid the first sucker in moving relative to the body and a second hinge portion formed in the second arm between the body and the second sucker to aid the second sucker in moving relative to the body.

17. The pacifier device of claim 16, wherein the first hinge portion includes a first stitched line formed across a width of the first arm and the second hinge portion includes a second stitched line formed across a width of the second arm.

18. The pacifier device of claim 1, wherein the attachment portion is coupled along a mirror plane of the sucker to the base portion.

19. The pacifier device of claim 18, wherein the first sucker includes a first half on a first side of the mirror plane and a second half on a second side of the mirror plane.

20. The pacifier device of claim 19, wherein the base portion has an outer perimeter, and an inner perimeter, and the base portion defines a first pair of breathing apertures therein and a second pair of breathing apertures therein, the first pair of breathing apertures being located in the first half of the sucker between the outer perimeter and inner perimeter and the second pair of breathing apertures being located in the second half of the sucker between the outer perimeter and the inner perimeter.

21. The pacifier device of claim 20, wherein the outer perimeter and the inner perimeter are generally circular.

22. The pacifier device of claim 1, wherein the second notch aids in providing access to a portion of the second sucker.

23. The pacifier device of claim 22, wherein the portion of the second sucker is a second finger cavity configured to receive at least a portion of a finger therein.

24. The pacifier device of claim 1, wherein in response to the first side or the second side lying uniformly against the surface of the user, both the first sucker and the second sucker adjustably move to aid the user in accessing the nipple portion of the first sucker and a second nipple portion of the second sucker.

25. The pacifier device of claim 1, wherein the first side and the second side are generally parallel to a mirror plane passing through at least the first sucker and the second sucker.

26. The pacifier device of claim 1, wherein the first notch and the second notch are both accessible when the first side or the second side of the body lies uniformly against the surface of the user.

27. The pacifier device of claim 1, wherein the first notch aids access to the portion of the first sucker by a second user and the second notch aids access to the portion of the second sucker by the second user.

* * * * *